US008162155B2

(12) United States Patent
Spencer et al.

(10) Patent No.: US 8,162,155 B2
(45) Date of Patent: Apr. 24, 2012

(54) DEVICE AND METHOD FOR SECURING A BILLIARDS CUE

(76) Inventors: Wesley Joseph Spencer, Waukesha, WI (US); Joseph William Quade, New Berlin, WI (US)

( * ) Notice: Subject to any disclaimer, the term of this patent is extended or adjusted under 35 U.S.C. 154(b) by 573 days.

(21) Appl. No.: 12/129,392

(22) Filed: May 29, 2008

(65) Prior Publication Data

US 2009/0294387 A1 Dec. 3, 2009

(51) Int. Cl.
*A47F 7/00* (2006.01)

(52) U.S. Cl. ..... 211/68; 473/1; 211/60.1

(58) Field of Classification Search ..... 211/60.1, 211/68, 183, 65, 70.3; 248/316.1, 205.5, 248/312, 316.7, 206.2; 473/30, 36, 37, 39, 473/42, 43

See application file for complete search history.

(56) References Cited

U.S. PATENT DOCUMENTS

| | | | | | |
|---|---|---|---|---|---|
| 69,026 | A | | 9/1867 | Richmond | |
| 143,885 | A | * | 10/1873 | Collender | 473/39 |
| 617,221 | A | | 1/1899 | Beattie | |
| 1,174,185 | A | | 3/1916 | Scott | |
| 1,240,705 | A | | 9/1917 | Grode | |
| 1,503,120 | A | | 7/1924 | Drost | |
| 1,743,442 | A | * | 1/1930 | Fanslau et al. | 248/537 |
| 2,142,019 | A | | 12/1938 | Warner | |
| 2,216,886 | A | | 10/1940 | Langelier | |
| 2,578,134 | A | * | 12/1951 | Headrick | 206/0.84 |
| 2,613,079 | A | | 10/1952 | Reynolds | |
| 3,259,348 | A | * | 7/1966 | Dann | 248/205.3 |
| 3,365,761 | A | | 1/1968 | Kalvig | |
| 3,476,261 | A | * | 11/1969 | McCutcheon et al. | 211/74 |
| 4,116,342 | A | | 9/1978 | Winfree | |
| 4,538,809 | A | * | 9/1985 | Boomer | 473/36 |
| 4,903,323 | A | | 2/1990 | Hendershot | |
| 4,915,332 | A | | 4/1990 | Ouellette | |
| 5,072,908 | A | * | 12/1991 | Lodrick | 248/231.81 |
| 5,139,221 | A | | 8/1992 | Lodrick | |
| 5,255,799 | A | | 10/1993 | Haynes | |
| 5,657,882 | A | | 8/1997 | Johnson | |
| 5,779,066 | A | * | 7/1998 | Drower et al. | 211/89.01 |
| 5,924,662 | A | * | 7/1999 | Monty | 248/205.2 |
| 6,402,104 | B1 | * | 6/2002 | Smith | 248/205.5 |
| 2002/0074299 | A1 | * | 6/2002 | Zummo | 211/68 |
| 2002/0111220 | A1 | * | 8/2002 | Trimino et al. | 473/42 |
| 2005/0247840 | A1 | * | 11/2005 | Zhadanov et al. | 248/316.7 |
| 2006/0208142 | A1 | * | 9/2006 | Adams | 248/206.2 |
| 2007/0193964 | A1 | * | 8/2007 | Helms | 211/68 |
| 2008/0197090 | A1 | * | 8/2008 | Goff | 211/68 |
| 2009/0186714 | A1 | * | 7/2009 | Van Buren et al. | 473/42 |
| 2009/0186715 | A1 | * | 7/2009 | Bush | 473/42 |
| 2010/0170862 | A1 | * | 7/2010 | Poisson | 211/68 |

* cited by examiner

*Primary Examiner* — Darnell Jayne
*Assistant Examiner* — Patrick Hawn
(74) *Attorney, Agent, or Firm* — Arent Fox LLP

(57) ABSTRACT

A billiards cue holder includes a body that defines at least one receiving groove sized to receive a billiards cue. In some aspects, each receiving groove includes a portion positioned toward the body at a receiving angle, which may increase a contact area with a cue leaned into the receiving groove. In some aspects, the body includes a mounting face that includes a concave portion. The concave portion is elastically deformable relative to a mounting surface to provide a holding force between the holder and the mounting surface. In some aspects, the holder comprises an elastomer material have a Shore A durometer between about 15 and about 55. Additionally, a method for securing a billiards cue in the holder includes positioning the holder on a mounting surface, applying pressure to deform a concave portion of a mounting face, and leaning a cue into the receiving groove.

25 Claims, 4 Drawing Sheets

DEVICE AND METHOD FOR SECURING A BILLIARDS CUE

RELATED APPLICATION(S)

The present application for patent is related to Provisional Application No. 60/927,087 entitled "Device for Securing a Billiards Cue" filed May 1, 2007, hereby expressly incorporated by reference herein.

BACKGROUND

The described aspects relate to the stowage and positioning of a billiard cue, especially between turns playing billiards.

The well-known and popular game of billiards is played using a slender tapered cylindrical rod called a cue to strike a cue ball into an object ball in an effort to send the object ball into a scoring pocket. A player continues playing until they fail to pocket an object ball or until they inadvertently pocket the cue ball, at which point the opponent is given an opportunity to take a turn. A cue holder is often used by the player to secure the cue between turns in an effort avert accidental damage to the cue from it falling to the floor. Prior art devices typically clamp to a securing surface such as a table top. These devices tend to be complex and are difficult to reposition once mounted. A simplified means for holding a billiards cue between turns is needed.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

In one aspect, a billiards cue holder comprises a body, a first external surface on the body defining at least one receiving groove sized to receive at least one billiards cue, and a second external surface on the body defining a mounting face operable to secure the holder to a mounting surface, wherein the mounting face comprises a concave portion.

In another aspect, a billiards cue holder comprises a body, a mounting face defined on the body; and at least one receiving groove defined in the body, each receiving groove comprising a first portion oriented at a receiving angle, wherein the receiving angle comprises a non-vertical angle.

In a further aspect, a billiards cue holder comprises a body having a top surface, a bottom mounting surface and an edge surface. The edge surface defines at least one receiving groove sized to receive a billiards cue. And, the body comprises an elastic material having a Shore A durometer in a range of about 15 to about 55.

In yet another aspect, a method of securing a billiards cue comprises placing a mounting face of billiards cue holder on a mounting surface, wherein the mounting face comprises a concave portion, applying pressure to the billiards cue holder to elastically deform the concave portion relative to the mounting surface, and leaning a cue into a receiving groove formed at an edge of the billiards cue holder.

The one or more aspects comprise the features hereinafter fully described and particularly pointed out in the claims. The following description and the annexed drawings set forth in detail certain illustrative features of the one or more aspects. These features are indicative, however, of but a few of the various ways in which the principles of the various aspects may be employed, and this description is intended to include all such aspects and their equivalents.

DETAILED DESCRIPTION

Figure 1:
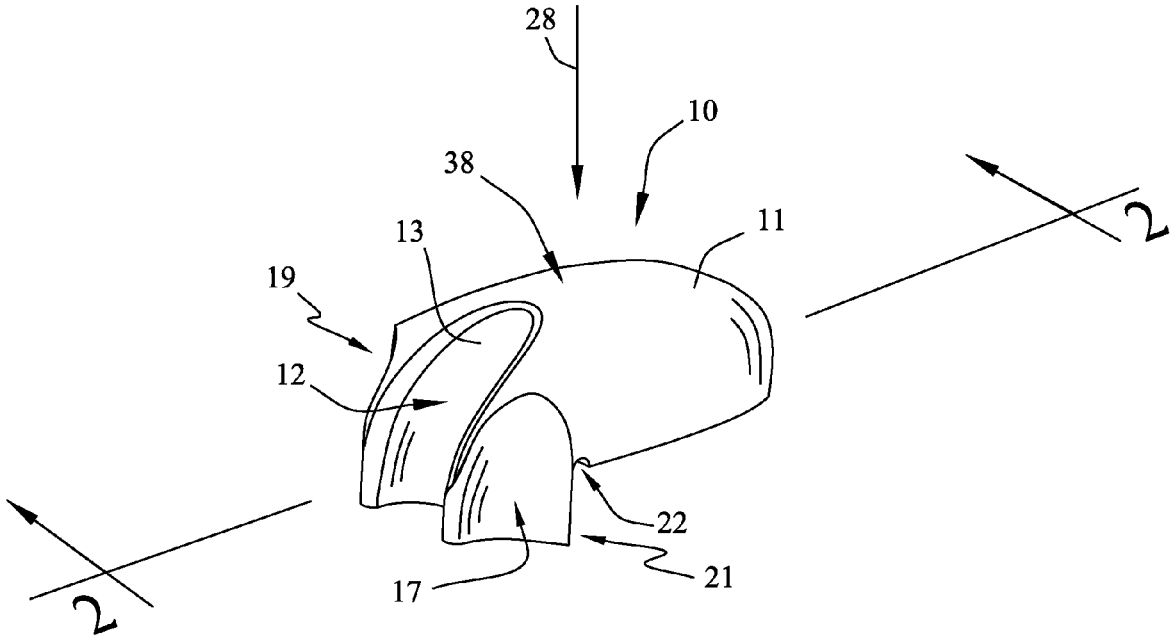
FIG. 1 is top perspective view of one aspect of a cue holder device.

Various aspects are now described with reference to the drawings. In the following description, for purposes of explanation, numerous specific details are set forth in order to provide a thorough understanding of one or more aspects. It may be evident, however, that such aspect(s) may be practiced without these specific details.

The device for securing a billiards cue comprises a holder having an elastomer body with a bottom mounting face and an edge face having a recess or groove region. The holder is preferably made from a relatively low durometer elastomer, such as a urethane, which provides a relatively high coefficient of friction with respect to a mounting surface on which the holder is placed. In use, the holder is positioned on a table top or other suitable mounting surface adjacent to an edge of the table top or mounting surface. In some aspects, a predetermined durometer of the elastomer material of the holder creates an adhesion force between the mounting face and the mounting surface helping to maintain the position of the holder with respect to the mounting surface or table top. In other optional aspects, the mounting face includes a concave portion, and slight pressure is applied to the top of the holder to at least partially flatten and evacuate the concave portion to create a small suction force helping to maintain the position of the holder with respect to the mounting surface or table top. The cue is then simply leaned into the recess or groove of the holder, with the butt end of the cue resting on the floor. Any side forces imparted to the holder by the cue due to slight misalignment are resisted by the adhesion force and/or suction force created when the holder was originally positioned on the mounting surface or table top. As such, the holder maintains its position and holds the cue in place, thereby securing the cue in between turns of play. When the cue is to be used, the cue can simply be lifted out of the recess or groove. If the player needs to reposition the holder, then the holder can be easily peeled from the mounting surface and repositioned as needed.

Referring to FIGS. 1-4, in one aspect, holder 10 includes a body 11 having at least one receiving groove 12 that defines a receiving angle 14 sized for securing a cue, and a mounting face 16 for securing holder 10 to a mounting surface. In some aspects, mounting face 16 may be oriented adjacent to an edge face 18, which can be positioned against an edge of the mounting surface. Further, in some aspects, mounting face 16 may further include a concave portion or concavity 20, which aids in securing holder 10 to the mounting surface. Additionally, in some optional aspects, holder 10 further includes a slot 22 separating mounting face 16 and edge face 18, for example, to allow holder 10 to be positioned across a radiused corner of a mounting surface. Moreover, holder 10 has a center-of-gravity (CG) 24 strategically positioned a predetermined distance 26 from edge face 18 to resist movement of holder 10 relative to mounting surface.

Receiving groove 12 is defined by an external surface 13, which may be curved in a horizontal plane to limit lateral movement of a billiards cue within groove 12. Further, receiving groove 12 may further include at least a top portion 15 angled or curved toward body 11 of holder 10. In particular, at least a section of receiving groove 12 closest to body 11 may be angled or curved toward body 11, such as by receiving angle 14. In some aspects, receiving angle 14 is oblique to a horizontal plane or oblique to a plane substantially within which mounting face 16 lies. For example, receiving angle 14 may be an angle in a range of between 0 degrees and 90 degrees. The curvature or angle of receiving groove 12 allows for an increased surface area contact between billiards cue and receiving groove 12, relative to a vertically-oriented surface, when cue is leaned into groove 12. The increased surface area contact increases an ability of receiving groove 12 to secure the billiards cue, and also may help to avoid having a point load or edge load transferred to the cue based on the weight of the leaning cue against holder 10.

Further, receiving groove 12 may be at least partially formed within an edge flange 21 extending from body 11 of holder 10. For example, edge flange 21 may be defined by external surface 13 of receiving groove 12 and the opposing edge face 18, which faces mounting face 16. Edge flange 21 extends beyond mounting face 16 and is positionable adjacent to a corresponding edge of a mounting surface, such as the edge or side of a table top. As such, edge flange 21 protects a billiards cue within receiving groove 12 from contacting an edge of the mounting surface. Further, edge face 18 provides additional surface area for contacting the corresponding edge of the mounting surface, thereby further resisting movement of holder 10 relative to the mounting surface.

Additionally, as noted above, in some aspects holder 10 may include slot 22 or groove that separates mounting face 16 from edge face 18. For example, slot 22 or groove may be formed at the intersection of mounting face 16 and edge face 18. Slot 22 separates faces 16 and 18 to allow edge face 18 to contact an edge or side of the mounting surface, for example, when a corner of the mounting surface is radiused or includes other structure separating the top and side of the mounting surface. Further, for example, slot 22 eliminates the need to form a sharp edge between edge face 18 and mounting face 16 to mate with a corresponding sharp edge of a mounting surface. As such, slot 22 provides a space to accommodate different edge structures in different mounting surfaces.

Figure 2:
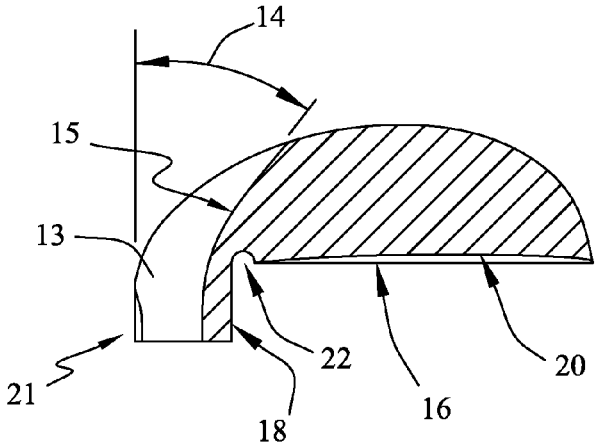
FIG. 2 is a partial sectional view along plane 2-2 of FIG. 1.
Figure 3:
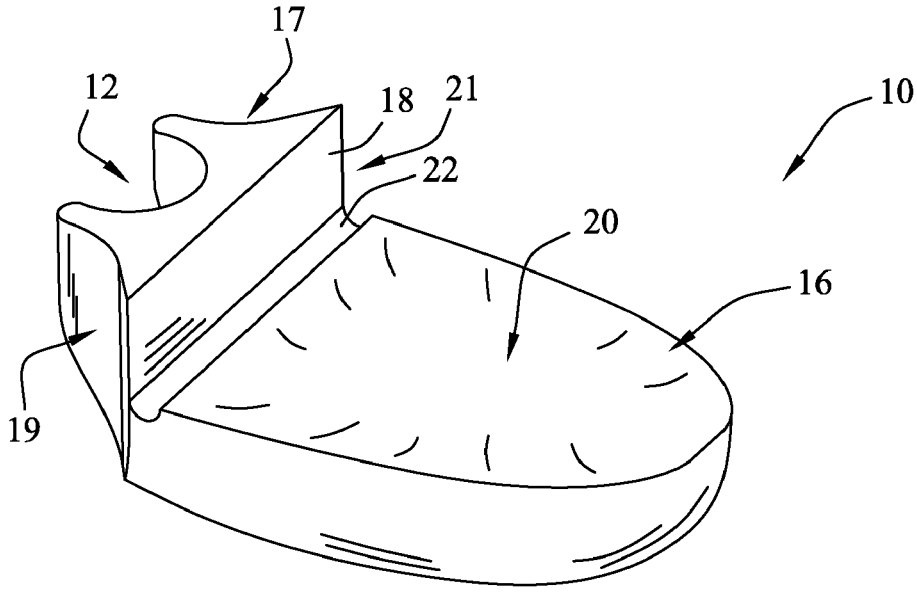
FIG. 3 is a bottom perspective view of one aspect of the device.
Figure 4:
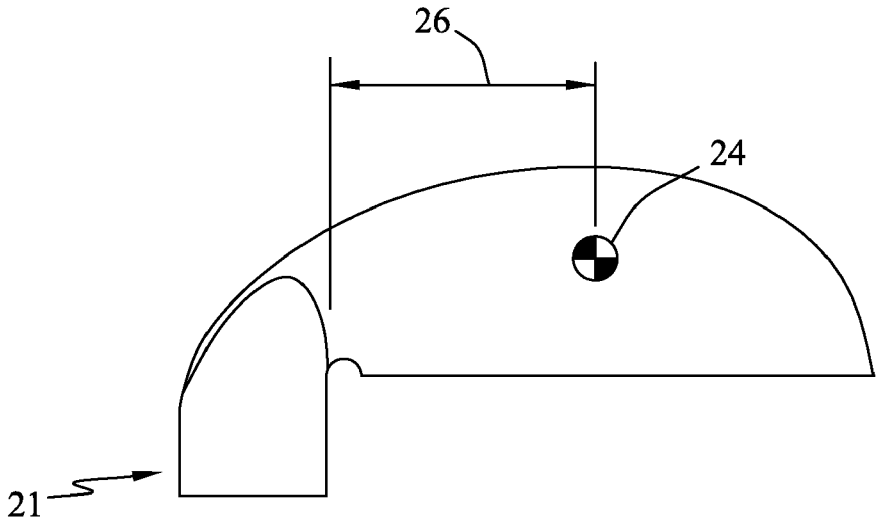
FIG. 4 is side view of one aspect of the device, including a representation of a center-of-gravity (CG) of the device.

Referring to FIGS. 2 and 3, concave portion or concavity 20 of mounting surface 18 may be formed across substantially all or any portion of mounting surface 18. For example, in some aspects, concave portion or concavity 20 may define a partially spherical surface, although other curved and/or linear surfaces may be utilized to create a space or air pocket between holder 10 and a mounting surface. Concave portion or concavity 20 is elastically deformable such that pressure applied to holder 10 in direction 28 (FIG. 1) at least partially forces out air within concave portion or concavity 20 when holder 10 is placed on the mounting surface. The compression of concave portion or concavity 20 thereby allows holder 10 to act like a suction cup, creating a suction force or an increased holding force between holder 10 and the mounting surface relative to the holding force prior to the deformation of concave portion or concavity 20.

Figure 5:
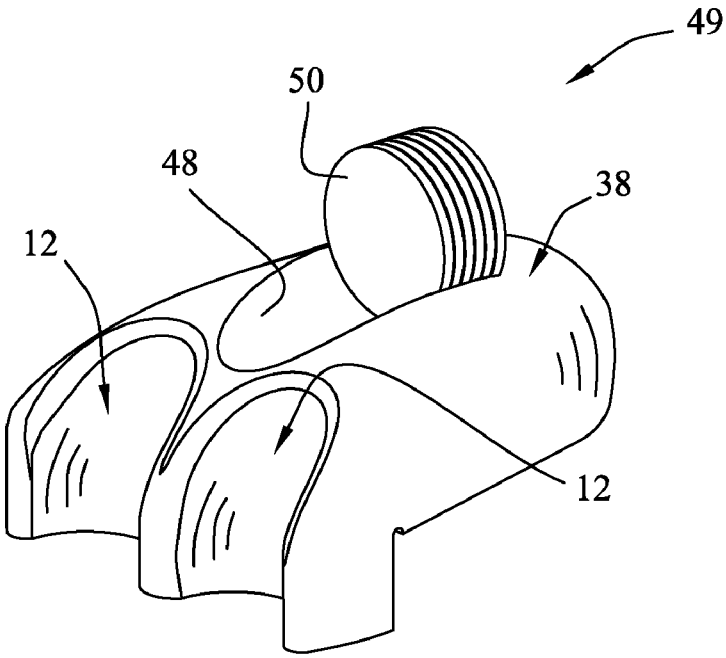
FIG. 5 is perspective view of another aspect of a cue holder device.
Figure 6:
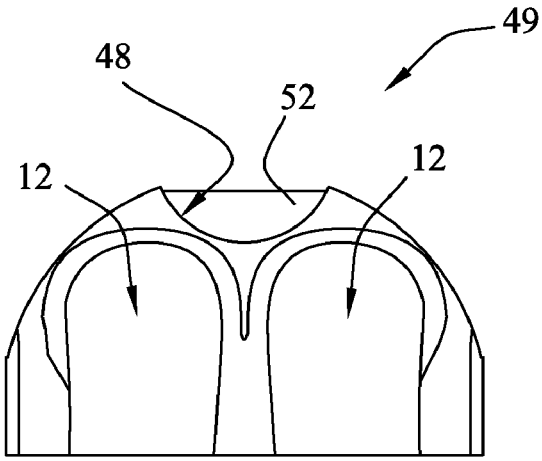
FIG. 6 is front view of the cue holder device of FIG. 5.

Further, additionally referring to billiards cue holder 49 of FIGS. 5-6 as well as FIGS. 1-4, in some aspects, external surface 13 may form more than one receiving groove 12. In some aspects, referring to FIGS. 1 and 3, additional receiving grooves 17 and 19 maybe be formed outside of receiving groove 12. In some aspects, additional receiving grooves 17 and 19 may have a different size and shape than receiving groove 12. For example, receiving grooves 17 and 19 may have less surface area and/or a smaller circumference than receiving groove 12. In other aspects, referring to FIGS. 6-7, each receiving groove 12 may be substantially identical, or symmetrical, in size and shape.

In some aspects, referring to FIGS. 5 and 6, holder 49 (or holder 10) may include a coin holder channel 48, defined by a portion of top surface 38, for holding one or more coins 50. In one aspect, for example, coin holder channel 48 may comprise a curved surface defining at least a partial cylinder having at least one wall 52 against which at least one coin 50 may be supported. It should be noted, however, that coin holder channel 48 may have other shapes, such as a rectangular or square shape, and may have two or more walls, such as defining one large slot or multiple individual coin sized slots, for supporting coins 50.

Figure 7:
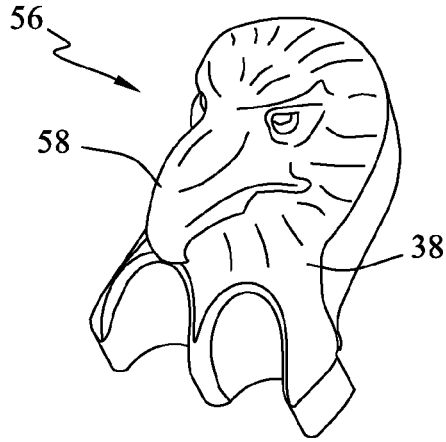
FIG. 7 is front view of another aspect of a cue holder device.

Additionally, referring to FIG. 7, in other aspects, holder 56 (or holder 10) may include an identifier element 58 formed on at least a portion of body 11, such as on at least a portion of top surface 38. For example, identifier element 58 may comprise an ornamental design or artistic representation, such as an eagle head, a shark head, a flower, a skull inside a hooded cloak, a melted billiards ball, or any other artistic design. Further, for example, identifier element 58 may include a name, number or branding identifier, such as a company or product logo, a company or product name, etc. In some aspects, identifier element 58 may comprise substantially an entirety of top surface 38 so as to provide holder 56 (or holder 10) with an individualized character or identity.

In some aspects, each holder 10, 49 and 56 is molded from a low durometer elastomer material having a relatively high surface static coefficient of friction. For example, holder 10 may be formed from an elastomer such as urethane rubber. It should be noted, however, that other elastomeric materials may be utilized, such as synthetic elastomers or natural rubbers, all of which are referred to as "elastomers" herein. Further, for example, in some aspects, the elastomer of holder 10 may have a Shore A durometer in the range of about 15 to about 55, or in other aspects in the range of about 15 to about 50, or in further aspects in the range of about 25 to about 35. Moreover, in some aspects, any one of holders 10, 49 and 56 may be molded from a plurality of different elastomers, such as a combination of a first elastomer having a first color and a second elastomer having a second color. For example, in some aspects, different colored elastomers may be molded into different portions of the holder to identify different parts of an identifier element 58. In other aspects, for example, different colored elastomers may be allowed to randomly mix together to create a unique artistic pattern of colored areas and/or color gradients.

Figure 8:
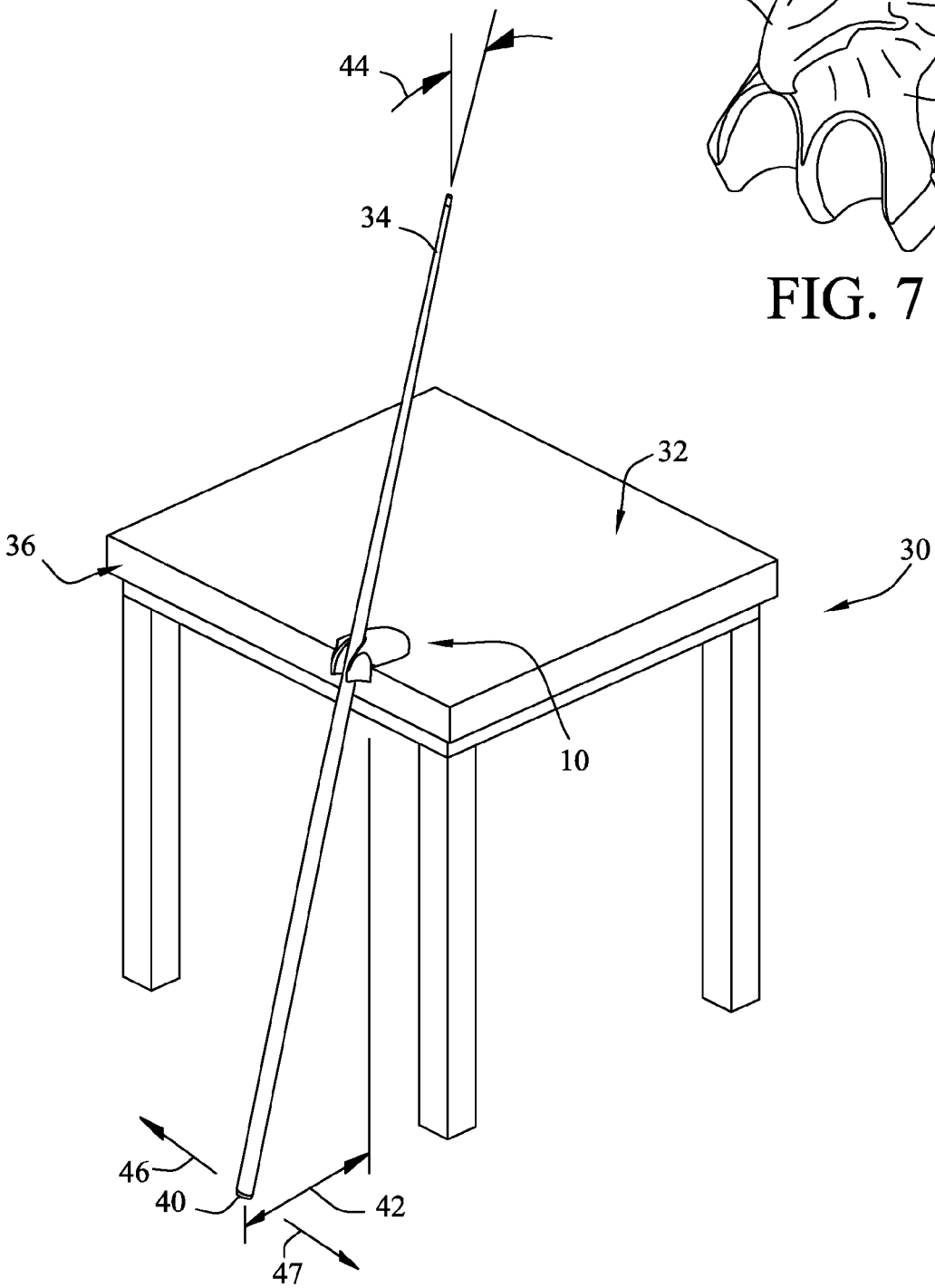
FIG. 8 is a perspective view of one aspect of the device in use, on a table, securing a cue.

Additionally referring to FIG. 8, in operation, holder 10 is positioned on table 30 such that mounting face 16 rests upon table top 32 and edge face 18 is in contact with table edge 36. A manual force is applied to holder top surface 38 in direction 28, which collapses concavity 20 upon table surface 32. The natural shape resiliency of holder 10 creates a slight vacuum between mounting surface 16 and table surface 32, giving rise to a holding force substantially in direction 28. Slot 22 ensures secure contact between mounting face 16 and mounting surface or table top 32 by eliminating the need for a molded radius between mounting face 16 and edge face 18. Further, CG 24 is positioned distance 26 from edge face 18 to ensure holder 10 does not tend to tip or otherwise become inadvertently disengaged from table top 32.

Further, cue 34 is positioned in receiving groove 12 with cue butt end 40 positioned distance 42 from table edge 36, resulting in positioning angle 44 that allows cue 34 to rest in receiving groove 12 at receiving angle 14. Should butt end 40 of cue 34 be positioned in either lateral direction 46 or 47, the high frictional properties of holder 10 and the aforementioned holding force in direction 28 help to keep holder 10 from moving or sliding relative to table top 32 and/or table edge 36.

While the foregoing disclosure discusses illustrative aspects and/or embodiments, it should be noted that various changes and modifications could be made herein without departing from the scope of the described aspects and/or embodiments as defined by the appended claims. Furthermore, although elements of the described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

What is claimed is:

1. A billiards cue holder, comprising:

a body;

a mounting face defined on the body;

an edge flange extending away from the body, wherein the edge flange is at least partially defined by at least one receiving groove and an edge face facing the mounting face; and a slot recessed into the body separating the edge face and the mounting face, wherein the mounting face further comprises a concave portion elastically deformable relative to a mounting surface to increase a holding force between the holder and the mounting surface.

2. A billiard cue holder, comprising:

a body;

a mounting face defined on the body;

an edge flange extending away from the body, wherein the edge flange is at least partially defined by at least one receiving groove and an edge face facing the mounting face; and a slot recessed into the body separating the edge face and the mounting face, wherein the holder comprises an elastic material having a Shore A durometer in a range of about 15 to about 55.

3. A billiard cue holder, comprising:

a body;

a mounting face defined on the body;

an edge flange extending away from the body, wherein the edge flange is at least partially defined by at least one receiving groove and an edge face facing the mounting face; and a slot recessed into the body separating the edge face and the mounting face, wherein the body further comprises a top surface on an opposite side of the body from the mounting face, wherein the top surface further comprises a channel sized to hold at least one coin.

4. The billiard cue holder of claim 1, wherein each receiving groove comprises a top portion oriented in an oblique direction relative to a vertical line.

5. The billiard cue holder of claim 1, wherein the top surface further comprises an identifier element.

6. The billiard cue holder of claim 1, wherein the at least one receiving groove is sized to receive at least one billiards cue.

7. The billiard cue holder of claim 1, wherein the concave portion is recessed within the mounting face.

8. The billiard cue holder of claim 1, wherein each receiving groove further comprises a top portion oriented at a receiving angle toward the body, wherein the receiving angle is in a range between 0 degrees and 90 degrees.

9. The billiard holder of claim 1, wherein each receiving groove further comprises an upper surface portion, wherein the upper surface portion is at least partially curved toward the body.

10. The billiard holder of claim 1, wherein the body comprises a center-of-gravity located a predetermined distance from the edge face, wherein the predetermined distance resists disengagement of the holder from the mounting surface.

11. The billiard cue holder of claim 2, wherein the holder comprises an elastic material having a Shore A durometer in a range of about 25 to about 35.

12. The billiard holder of claim 1, wherein the at least one receiving groove includes a plurality of receiving grooves each sized to receive at least one billiards cue, wherein at least two of the plurality of receiving grooves have different sizes.

13. The billiard cue holder of claim 2, wherein each receiving groove comprises a top portion oriented in an oblique direction relative to a vertical line.

14. The billiard cue holder of claim 3, wherein each receiving groove comprises a top portion oriented in an oblique direction relative to a vertical line.

15. The billiard cue holder of claim 2, wherein each receiving groove further comprises a top portion oriented at a receiving angle toward the body, wherein the receiving angle is in a range between 0 degrees and 90 degrees.

16. The billiard cue holder of claim 3, wherein each receiving groove further comprises a top portion oriented at a receiving angle toward the body, wherein the receiving angle is in a range between 0 degrees and 90 degrees.

17. The billiard holder of claim 2, wherein each receiving groove further comprises an upper surface portion, wherein the upper surface portion is at least partially curved toward the body.

18. The billiard holder of claim 3, wherein each receiving groove further comprises an upper surface portion, wherein the upper surface portion is at least partially curved toward the body.

19. The billiard cue holder of claim 2, wherein the at least one receiving groove is sized to receive at least one billiards cue.

20. The billiard cue holder of claim 3, wherein the at least one receiving groove is sized to receive at least one billiards cue.

21. The billiard holder of claim 2, wherein the at least one receiving groove includes a plurality of receiving grooves each sized to receive at least one billiards cue, wherein at least two of the plurality of receiving grooves have different sizes.

22. The billiard holder of claim 3, wherein the at least one receiving groove includes a plurality of receiving grooves each sized to receive at least one billiards cue, wherein at least two of the plurality of receiving grooves have different sizes.

23. The billiard holder of claim 1, wherein the holder comprises an elastic material having a Shore A durometer in a range of about 15 to about 55.

24. The billiard holder of claim 1, wherein the body further comprises a top surface on an opposite side of the body from the mounting face, wherein the top surface further comprises a channel sized to hold at least one coin.

25. The billiard holder of claim 2, wherein the body further comprises a top surface on an opposite side of the body from the mounting face, wherein the top surface further comprises a channel sized to hold at least one coin.

* * * * *